US009677805B2

(12) United States Patent
Vijayan et al.

(10) Patent No.: US 9,677,805 B2
(45) Date of Patent: Jun. 13, 2017

(54) REFRIGERATOR APPLIANCE AND A METHOD FOR OPERATING A REFRIGERATOR APPLIANCE

(71) Applicant: General Electric Company, Schenectady, NY (US)

(72) Inventors: Vineeth Vijayan, Louisville, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 375 days.

(21) Appl. No.: 14/306,277

(22) Filed: Jun. 17, 2014

(65) Prior Publication Data

US 2015/0362246 A1 Dec. 17, 2015

(51) Int. Cl.

| | |
|---|---|
| ***F25D 17/06*** | (2006.01) |
| ***F25D 21/14*** | (2006.01) |
| ***F25D 23/12*** | (2006.01) |
| ***F24F 11/00*** | (2006.01) |

(52) U.S. Cl.

CPC ..... *F25D 21/14* (2013.01); *F24F 11/0008* (2013.01); *F25D 23/12* (2013.01); *F25B 2700/02* (2013.01); *F25D 2321/147* (2013.01); *F25D 2700/14* (2013.01)

(58) Field of Classification Search

CPC .. F25D 17/06; F25D 21/14; F25D 2317/0413; F25D 2317/04131; F25D 2321/147; F25D 2321/146

See application file for complete search history.

(56) References Cited

U.S. PATENT DOCUMENTS

| | | | | |
|---|---|---|---|---|
| 2,031,055 | A | 2/1936 | Grimes | |
| 5,578,753 | A * | 11/1996 | Weiss | F24F 3/14 219/494 |
| 2008/0256974 | A1* | 10/2008 | Verma | F25B 9/008 62/498 |
| 2011/0233289 | A1* | 9/2011 | Bortoletto | F25D 17/042 236/44 A |
| 2012/0017612 | A1* | 1/2012 | Junge | F25D 21/04 62/89 |
| 2012/0036877 | A1* | 2/2012 | Austin | F25B 39/04 62/176.1 |
| 2013/0276471 | A1* | 10/2013 | Austin | F25D 21/14 62/291 |
| 2014/0150458 | A1* | 6/2014 | Boarman | F25C 5/005 62/3.3 |

* cited by examiner

*Primary Examiner* — Elizabeth Martin
(74) *Attorney, Agent, or Firm* — Dority & Manning, P.A.

(57) ABSTRACT

A refrigerator appliance is provided. The refrigerator appliance includes features for increasing humidity of an atmosphere about the refrigerator appliance. A method for operating a refrigerator appliance is also provided. The method includes measuring a relative humidity of air about the refrigerator appliance and operating a humidifier of the refrigerator appliance if the relative humidity of air about the refrigerator appliance is less than a reference value.

18 Claims, 3 Drawing Sheets

REFRIGERATOR APPLIANCE AND A METHOD FOR OPERATING A REFRIGERATOR APPLIANCE

FIELD OF THE INVENTION

The present subject matter relates generally to refrigerator appliances.

BACKGROUND OF THE INVENTION

Dry air or low humidity conditions, such as conditions where the relative humidity is less than thirty percent, can have various unpleasant effects. For example, low humidity conditions can cause health related issues, such as itchy eyes, sore throat and cracked skin. Dry air also facilitates static electricity accumulation that can cause painful shocks and damage computers or other electronic equipment. In addition, hardwood floors lose moisture and contract in low humidity conditions. House plants can also suffer in low humidity conditions, and wallpaper can peel away from walls in dry air.

Humidifiers include features for evaporating liquid water in order to increase an ambient humidity around the humidifiers. By increasing the ambient humidity, humidifiers can assist with alleviating the unpleasant effects associated with dry air and low humidity conditions. However, humidifiers generally suffer from certain drawbacks. For example, a user of a humidifier may have to frequently refill the humidifier with fresh water. Such refilling can be tedious and inconvenient. In addition, humidifiers can cumbersome and consume large amounts of valuable floor space within a room. Humidifiers can also be expensive to purchase and/or operate.

Accordingly, an appliance with features for increasing an ambient humidity about the appliance would be useful. For example, a refrigerator appliance with features for increasing an ambient humidity about the refrigerator appliance would be useful. In particular, a refrigerator appliance that does not require a user of the refrigerator appliance to manually add fresh water to the refrigerator appliance in order to increase an ambient humidity about the refrigerator appliance would be useful.

BRIEF DESCRIPTION OF THE INVENTION

The present subject matter provides a refrigerator appliance. The refrigerator appliance includes features for increasing humidity of an atmosphere about the refrigerator appliance. A method for operating a refrigerator appliance is also provided. The method includes measuring a relative humidity of air about the refrigerator appliance and operating a humidifier of the refrigerator appliance if the relative humidity of air about the refrigerator appliance is less than a reference value. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber. The cabinet also defines a mechanical compartment at a bottom portion of the cabinet. A sealed system is charged with a refrigerant and is configured for generating chilled air within the chilled chamber of the cabinet. The sealed system includes a condenser positioned within the mechanical compartment of the cabinet. An evaporation pan is positioned below the condenser of the sealed system within the mechanical compartment of the cabinet. An air handler is positioned adjacent the condenser of the sealed system. The air handler is operable to urge a flow of air across the condenser and the evaporation pan. The refrigerator appliance also includes a humidity sensor. A controller is in operative communication with the air handler and the humidity sensor. The controller is configured for receiving a humidity measurement for air at the cabinet from the humidity sensor and activating the air handler if the humidity measurement for air at the cabinet is less than a reference value.

In a second exemplary embodiment, a refrigerator appliance is provided. The refrigerator appliance includes a cabinet that defines a chilled chamber. A sealed system is charged with a refrigerant and is configured for generating chilled air within the chilled chamber of the cabinet. The refrigerator appliance also includes means for measuring humidity of an atmosphere about the cabinet and means for increasing humidity of the atmosphere about the cabinet.

In a third exemplary embodiment, a method for operating a refrigerator appliance is provided. The method includes directing refrigerant through a condenser of the refrigerator appliance, measuring a relative humidity of air about the refrigerator appliance, and operating an air handler of the refrigerator appliance in order to direct a flow of air across the condenser and an evaporation pan of the refrigerator appliance if the relative humidity of air about the refrigerator appliance is less than a reference value at the step of measuring. Liquid water within the evaporation pan evaporates during the step of operating.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
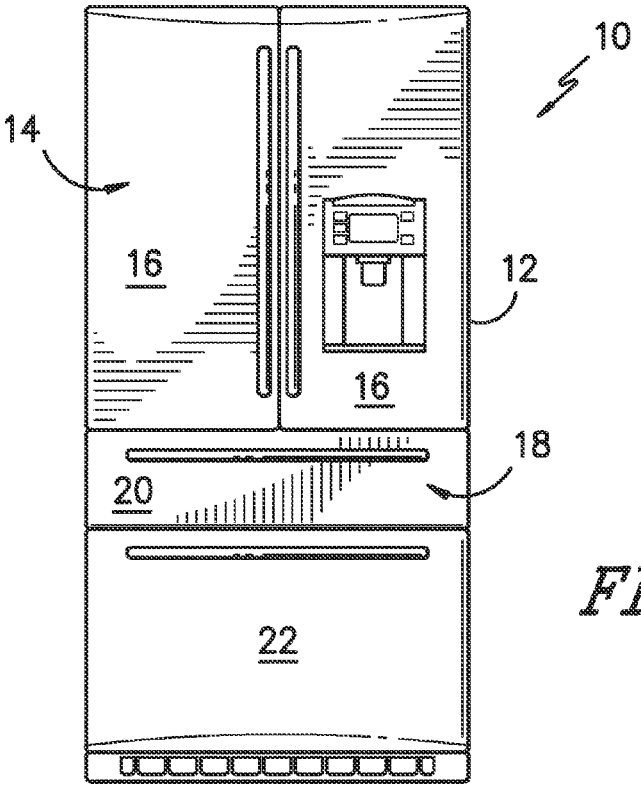
FIG. 1 is a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a refrigerator appliance 10 according to an exemplary embodiment of the present subject matter. It should be appreciated that the term "refrigerator appliance" is used in a generic sense herein to encompass any manner of refrigeration appliance, such as a freezer, refrigerator/freezer combination, and any style or model of conventional refrigerator. In the illustrated exemplary embodiment, refrigerator appliance 10 is depicted as an upright refrigerator having a cabinet or casing 12 that defines chilled compartments for storage of food items therein. In particular, the refrigerator appliance 10 includes upper fresh-food compartments 14 having doors 16 and lower freezer compartment 18 having upper drawer 20 and lower drawer 22. The drawers 20, 22 are "pull-out" drawers in that they can be manually moved into and out of the freezer compartment 18 on suitable slide mechanisms.

Figure 2:
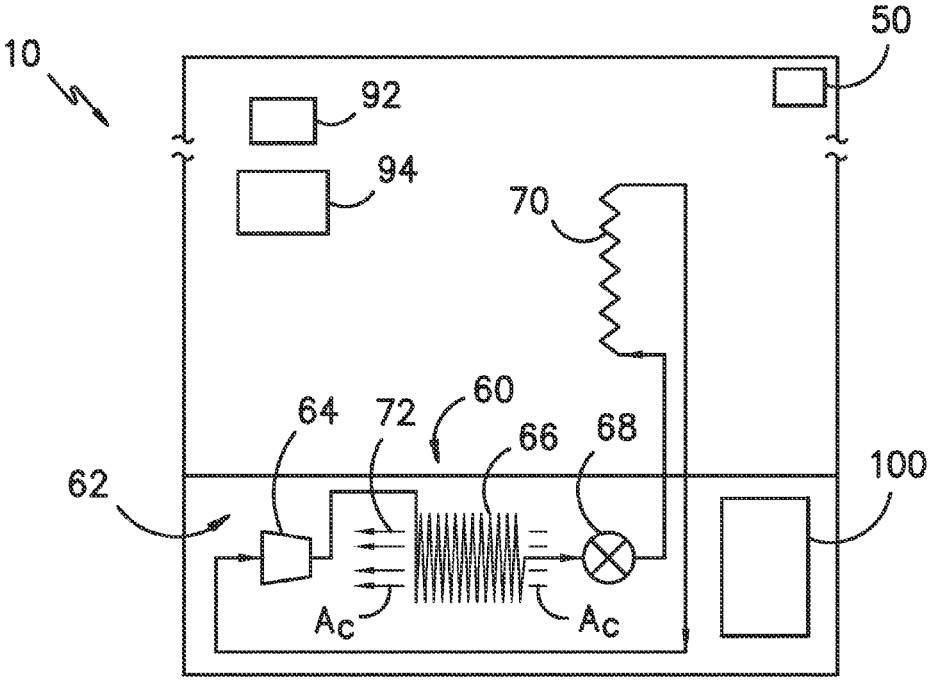
FIG. 2 is schematic view of certain components of the exemplary refrigerator appliance of FIG. 1.

FIG. 2 is a schematic view of certain components of refrigerator appliance 10 including a sealed refrigeration system 60. A machinery compartment 62 (e.g., positioned at a bottom portion of casing 12) contains components for executing a known vapor compression cycle for cooling air. The components include a compressor 64, a condenser 66, an expansion valve 68, and an evaporator 70 connected in series and charged with a refrigerant. As will be understood by those skilled in the art, sealed system 60 may include additional components, e.g., at least one additional evaporator, compressor, expansion valve, and/or condenser. As an example, sealed system 60 may include two evaporators.

Within sealed system 60, gaseous refrigerant flows into compressor 64, which operates to increase the pressure of the refrigerant. This compression of the refrigerant raises its temperature, which is lowered by passing the gaseous refrigerant through condenser 66. Within condenser 66, heat exchange with ambient air takes place so as to cool the refrigerant and cause the refrigerant to condense to a liquid state. An air handler or fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives liquid refrigerant from condenser 66. From expansion device 68, the liquid refrigerant enters evaporator 70. Upon exiting expansion device 68 and entering evaporator 70, the liquid refrigerant drops in pressure and, e.g., at least partially, vaporizes. Due to the pressure drop and phase change of the refrigerant, evaporator 70 is cool relative to compartments 14, 18 of refrigerator appliance 10 (FIG. 1). As such, cooled air is produced and configured to refrigerate compartments 14, 18 of refrigerator appliance 10 (FIG. 1). Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through refrigeration compartments 14, 18 (FIG. 1). The sealed system 60 depicted in FIG. 2 is provided by way of example only. Thus, it is within the scope of the present subject matter for other configurations of the sealed system to be used as well.

Refrigerator appliance 10 is further equipped with a controller 50 to regulate operation of refrigerator appliance 10. Thus, controller 50 is in operative communication with various components of refrigerator appliance 10 including compressor 64. Controller 50 may selectively activate and deactivate compressor 64 in order to operate sealed system 60 in the manner described above.

Controller 50 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 50 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 50 may be positioned in a variety of locations throughout refrigerator appliance 10. Input/output ("I/O") signals may be routed between the controller 50 and various operational components of refrigerator appliance 10 along wiring harnesses that may be routed through casing 12. The controller 50 may include a user interface panel (not shown) through which a user may select various operational features and modes and monitor progress of the refrigerator appliance 10. The user interface panel of controller 50 may represent a general purpose I/O ("GPIO") device or functional block. In one embodiment, the user interface panel of controller 50 may include input components, such as one or more of a variety of electrical, mechanical or electromechanical input devices including rotary dials, push buttons, and touch pads. The user interface panel of controller 50 may also include a display component, such as a digital or analog display device designed to provide operational feedback to a user.

It should be understood that during operation of sealed system 60 water vapor, e.g., from air within refrigeration compartments 14, 18 (FIG. 1) can freeze upon contact with evaporator 70. For example, refrigerant within evaporator 70 may reach a temperature below the freezing point of water. Thus, water vapor contacting evaporator 70 may freeze and create a frost buildup (not shown) on evaporator 70. Such frost buildup may continue to grow during operation of sealed system 60. For example, when a user opens freezer doors 20, 22 and permits fresh water vapor containing air to enter freezer chamber 18.

Figure 3:
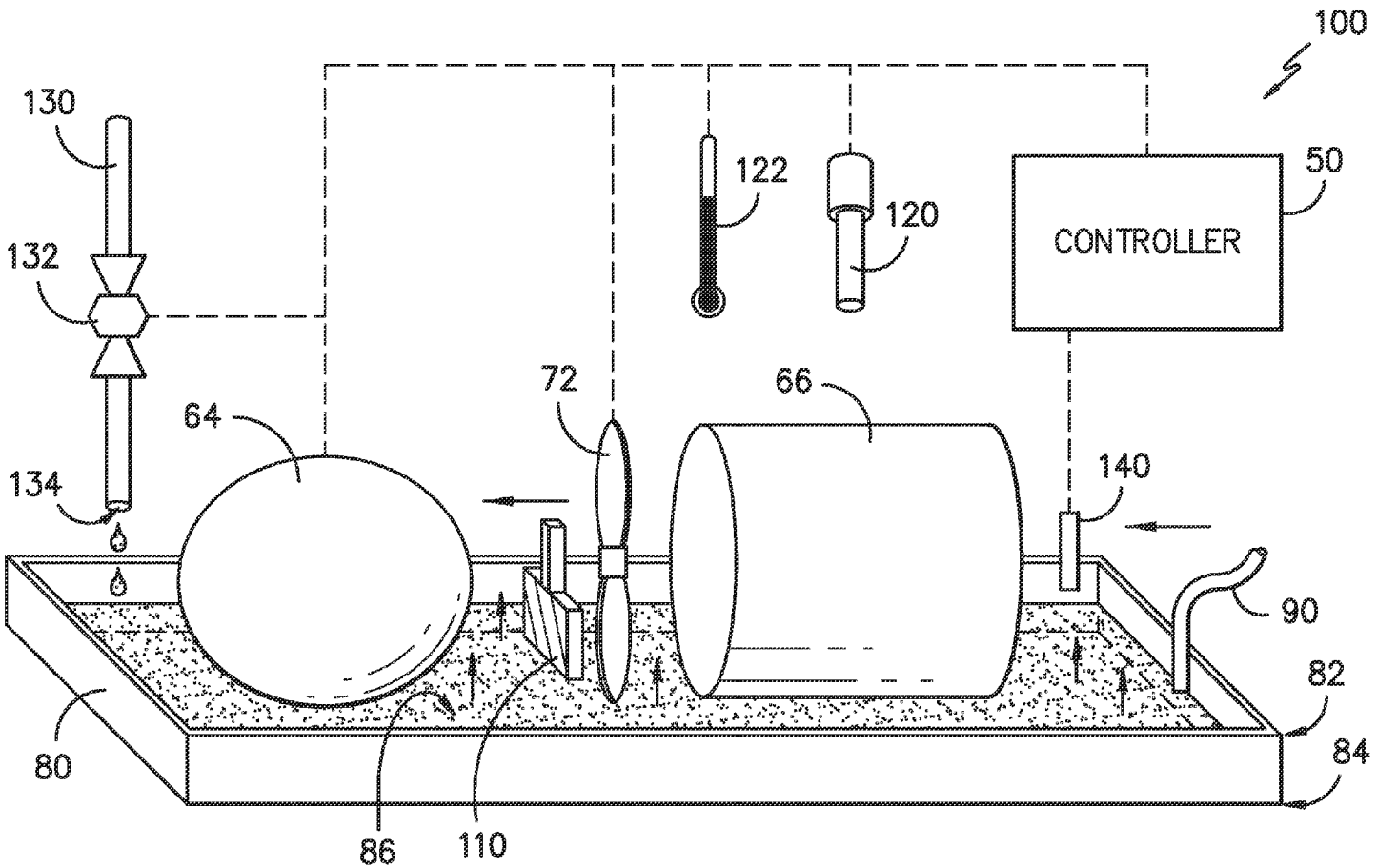
FIG. 3 provides another schematic view of certain components of the exemplary refrigerator appliance of FIG. 1 including a humidifier of the exemplary refrigerator appliance.

To avoid potential negative effects of such frost build up on sealed system 60 operation, sealed system 60 is configured for executing a defrost cycle. For example, sealed system 60 may deactivate compressor 64 for a period of time sufficient for the frost buildup on evaporator 70 to melt. As another example, a heating element may be activated to melt the frost buildup. However, when the frost buildup melts, a volume of liquid runoff (e.g, water) is produced that can freeze upon reactivation of compressor 64 and negatively affect sealed system 60 and, in particular, evaporator 70. Thus, such liquid runoff is directed away from evaporator 70 via a drain line or conduit 90 (FIG. 3). In the exemplary embodiment shown in FIG. 2, the liquid runoff is directed to an evaporation pan 80 (FIG. 3).

Refrigerator appliance 10 also includes an ice maker 92 and an ice bucket 94. Ice maker 92 is configured for generating or forming ice cubes. Ice cubes from ice maker 92 are directed to and stored within an ice bucket 94. Sealed system 60 can maintain air around ice bucket 94 below the freezing temperature of water in order to limit or prevent melting of ice cubes within ice bucket 94. However, sealed system 60 can stop functioning for a variety of reasons, such as disruption of an electrical power supply to sealed system 60, mechanical failure, etc. If ice cubes within ice bucket 94 are not maintained below the freezing temperature of water, ice cubes within ice bucket 94 melt and generate liquid runoff. Such liquid runoff can fill ice bucket 94 and negatively affect operation of refrigeration appliance 10. Thus, such liquid runoff is directed out of ice bucket 94 via drain conduit 90 (FIG. 3). In the exemplary embodiment shown in FIG. 2, the liquid runoff is directed to evaporation pan 80 (FIG. 3).

Refrigerator appliance 10 also includes features for increasing humidity of an atmosphere about refrigerator appliance 10. In particular, refrigerator appliance 10 includes a humidifier 100 positioned within machinery compartment 62 at the bottom portion of casing 12. Humidifier 100 is operatively coupled to controller 50 such that controller 50 may selectively activate and deactivate humidifier 100, as discussed in greater detail below. Humidifier 100 may be any suitable type of humidifier. For example, humidifier 100 may be a cool mist humidifier, a warm mist humidifier, an ultrasonic humidifier or a mechanical humidifier.

FIG. 3 provides another schematic view of certain components of refrigerator appliance 10 including humidifier 100. In the exemplary embodiment shown in FIG. 3, humidifier 100 operates in a similar manner to a warm mist humidifier. As discussed above, humidifier 100 may be any suitable humidifier for increasing humidity of an atmosphere about refrigerator appliance 10 in alternative exemplary embodiments. Humidifier 100 is discussed in greater detail below.

As may be seen FIG. 3, refrigerator appliance 10 includes evaporation pan 80. Evaporation pan 80 extends between a top portion 82 and a bottom portion 84, e.g., along a vertical direction. Evaporation pan 80 also defines a containment volume 86. Liquid water directed to evaporation pan 80 flows into containment volume 86 and is stored within containment volume 86. Evaporation pan 80 is open or uncovered at top portion 82 of evaporation pan 80 such that liquid water stored within containment volume 86 of evaporation pan 80 is exposed to ambient atmosphere, e.g., and evaporates over time.

Refrigerator appliance 10 includes various features for facilitating or assisting with evaporating liquid water from containment volume 86 of evaporation pan 80. For example, fan 72 is positioned adjacent, e.g., directly above, evaporation pan 80 and is positioned and/or oriented for urging a flow of air across or over liquid water within containment volume 86 of evaporation pan 80 during operation of fan 72. Thus, fan 72 may urge a flow of air across both condenser 66 and evaporation pan 80. Evaporation pan 80 is also positioned, e.g., directly, below condenser 66 within machinery compartment 62 of casing 12. Refrigerant within condenser 66 can assist with heating air directed towards liquid water within containment volume 86 of evaporation pan 80 by fan 72 in order to assist with evaporating liquid water from containment volume 86 of evaporation pan 80. In addition, coils of condenser 66 may extend into containment volume 86 of evaporation pan 80 in order to facilitate heat transfer between refrigerant within condenser 66 and the liquid water within containment volume 86 of evaporation pan 80.

Humidifier 100 also includes a wick 110. Wick 110 is positioned within containment volume 86 of evaporation pan 80 and extends from containment volume 86 of evaporation pan 80 towards the flow of air from fan 72. Wick 110 is configured for drawing or wicking liquid water from containment volume 86 of evaporation pan 80 towards the flow of air from fan 72. Thus, liquid water within wick 110 may be distributed or disposed within the flow of air from fan 72 in order to assist with evaporating such water. Wick 110 may include any suitable hydroscopic or absorptive material that is suitable for moving liquid water from containment volume 86 of evaporation pan 80 towards flows of air from fan 72, e.g., via capillary action. For example, wick 110 may include a sponge or a fibrous material.

Humidifier 100 also includes a humidity sensor 120 and a temperature sensor 122. Humidity sensor 120 and temperature sensor 122 are in operative communication with controller 50 such that measurement or signals from humidity sensor 120 and temperature sensor 122 may be received and/or recorded by controller 50. Humidity sensor 120 is configured for measuring a, e.g., relative, humidity of air about refrigerator appliance 10. Humidity sensor 120 may be any suitable type of humidity sensor. For example, humidity sensor 120 may be a resistive humidity sensor, a capacitive humidity sensor, a thermal conductivity humidity sensor or a psychrometer. Temperature sensor 122 is configured for measuring a temperature of air about refrigerator appliance 10. Temperature sensor 122 may be any suitable type of temperature sensor. For example, temperature sensor 122 may be a thermocouple or a thermistor. Temperature measurements from temperature sensor 122 may assist humidity sensor 120 and/or controller 50 with more accurately and/or precisely measuring the humidity of air about refrigerator appliance 10, as will be understood by those skilled in the art.

As discussed above, controller 50 is in operative communication with fan 72 and humidity sensor 120. In particular, controller 50 is programmed or configured for receiving a humidity measurement for air at or around casing 12 of refrigerator appliance 10 from humidity sensor 120. Controller 50 is also programmed or configured for activating fan 72 and blowing or urging air across containment volume 86 of evaporation pan 80 if the humidity measurement for air at or around casing 12 of refrigerator appliance 10 is less than a reference value, e.g., thirty percent relative humidity. When fan 72 is operating, air from fan 72 evaporates liquid water within containment volume 86 of evaporation pan 80 and thereby increases the humidity of air about or around casing 12 of refrigerator appliance 10. Thus, controller 50 may activate humidifier 100 in order to increase the humidity of air at or around casing 12 if controller 50 detects that the humidity of air at or around casing 12 is low. In addition, operation of humidifier 100 also assists with cooling refrigerant within condenser 66, as discussed above. Thus, humidifier 100 may operate efficiently relative to separate humidifiers and refrigerator appliances.

Humidifier 100 also includes a water conduit 130 and a valve 132, such as solenoid valve. Water conduit 130 is configured to be coupled or connected to a water supply (not shown), such as a municipal water supply or a well. An outlet 134 of water conduit 130 is positioned at or adjacent containment volume 86 of evaporation pan 80. Thus, water conduit 130 may extend from the water supply to containment volume 86 of evaporation pan 80.

Valve 132 is coupled or mounted to water conduit 130. When valve 132 is open, liquid water from the water supply flows through water conduit 130 into containment volume 86 of evaporation pan 80. Conversely, valve 132 blocks or prevents liquid water from flowing from water conduit 130 into containment volume 86 of evaporation pan 80 when valve 132 is closed. Controller 50 is operatively coupled to valve 132 and is configured for selectively opening and closing valve 132 in order to regulate the flow of liquid water from water conduit 130 into containment volume 86 of evaporation pan 80, as discussed in greater detail below.

As may be seen in FIG. 3, humidifier 100 includes a water level sensor 140. Water level sensor 140 is positioned at or adjacent containment volume 86 of evaporation pan 80. Water level sensor 140 is configured for measuring or determining a height of liquid water within containment volume 86 of evaporation pan 80. Water level sensor 140 may be any suitable type of sensor for measuring or determining the height of liquid water within containment volume 86 of evaporation pan 80. For example, water level sensor 140 may be a float ball sensor, a float switch, a pressure transducer or switch, a conductive water level sensor, an optical sensor, etc. Controller 50 is in operative communication with water level sensor 140. Controller 50 is programmed or configured for opening valve 132 in order to direct liquid water into containment volume 86 of evaporation pan 80 via water conduit 130 when water level sensor 140 signals controller 50 that the height of water within containment volume 86 of evaporation pan 80 is less than a predetermined height. Thus, in certain exemplary embodiments, a user need not manually fill containment volume 86 of evaporation pan 80 with water in order to operate humidifier 100.

Refrigerator appliance 10 also includes drain conduit 90. As discussed above, drain conduit 90 extends between evaporator 70 of sealed system 60 (FIG. 2) and containment volume 86 of evaporation pan 80. Thus, liquid runoff from evaporator 70 and/or ice bucket 94 may be directed to containment volume 86 of evaporation pan 80 during defrosting of evaporator 70. Such liquid runoff may assist with limiting or reducing a volume of fresh water from water conduit 130 required for operating humidifier 100. In addition, in certain exemplary embodiments, humidifier 100 need not include water conduit 130 and valve 132 and may rely upon liquid runoff from evaporator 70 and manual refilling of evaporation pan 80 to supply liquid water for humidifier 100.

Figure 4:
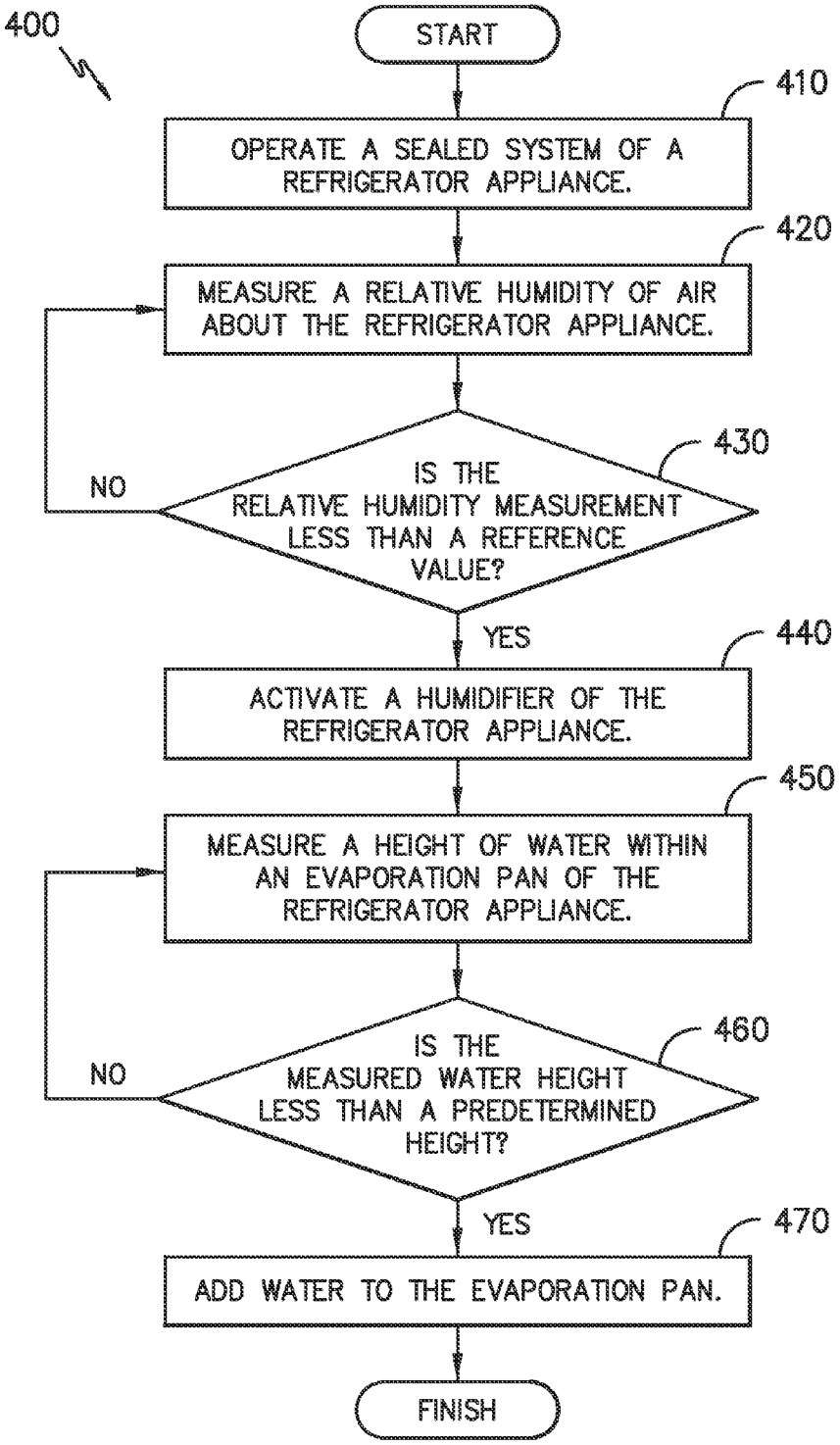
FIG. 4 illustrates a method for operating a refrigerator appliance according to an exemplary embodiment of the present subject matter.

FIG. 4 illustrates a method 400 for operating a refrigerator appliance according to an exemplary embodiment of the present subject matter. Method 400 may be used to operate any suitable refrigerator appliance. For example, method 400 may be used to operate refrigerator appliance 10. Controller 50 of refrigerator appliance 10 may be programmed or configured to implement method 400.

At step 410, controller 50 operates or works sealed system 60 in order to cool fresh food and freezer chambers 14, 18. For example, controller 50 may activate compressor 64 such that, e.g., hot, refrigerant flows through condenser 66 at step 410. At step 420, a relative humidity of air about refrigerator appliance 10 is measured or determined. For example, controller 50 may receive a signal from humidity sensor 120 corresponding to the relative humidity of air about refrigerator appliance 10 at step 420. At 430, controller 50 determines whether the relative humidity of air about refrigerator appliance 10 measured at step 420 is less than a predetermined value, e.g., fifty percent relative humidity, forty percent relative humidity or thirty percent relative humidity. At step 450, controller 50 activates or operates fan 72 is if the measured relative humidity of air about refrigerator appliance 10 is less than the reference value at step 440.

When fan 72 is operated at step 450, fan 72 directs a flow of air across the condenser 66 and evaporation pan 80. The flow of air from fan 72 evaporates water within containment volume 86 of evaporation pan 80 and thereby increases the relative humidity of air about refrigerator appliance 10. Refrigerant within condenser 66 may heat the flow of air prior to the flow of air crossing evaporation pan 80 in order to increase or assist evaporation of liquid water within containment volume 86 of evaporation pan 80 with the flow of air from fan 72. Thus, controller 50 may activate fan 72 to increase the relative humidity of air about refrigerator appliance 10 at step 450 if the air about refrigerator is dry. In such a manner, method 400 utilizes various components of refrigerator appliance 10 in order to humidify air about refrigerator appliance 10.

At step 460, the height of liquid water within containment volume 86 of evaporation pan 80 is determined or measured. For example, controller 50 may receive a signal from water level sensor 140 in order to determine the height of liquid water within containment volume 86 of evaporation pan 80 at step 460. At step 470, controller 50 opens valve 132 if the height of liquid water within containment volume 86 of evaporation pan 80 is less than a predetermined height. Thus, controller 50 may open valve 132 and automatically refill containment volume 86 of evaporation pan 80 with liquid water to permit further operation of humidifier 100 without requiring manual refilling of evaporation pan 80.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet that defines a chilled chamber, the cabinet also defining a mechanical compartment at a bottom portion of the cabinet;

a sealed system charged with a refrigerant and configured for generating chilled air within the chilled chamber of the cabinet, the sealed system comprising a condenser and an evaporator, the condenser positioned within the mechanical compartment of the cabinet, the evaporator positioned at the chilled chamber of the cabinet;

an evaporation pan positioned below the condenser of the sealed system within the mechanical compartment of the cabinet;

an air handler positioned adjacent the condenser of the sealed system, the air handler operable to urge a flow of air across the condenser and the evaporation pan;

a humidity sensor; and a controller in operative communication with the air handler and the humidity sensor, the controller configured for receiving a humidity measurement for air at the cabinet from the humidity sensor and activating the air handler if the humidity measurement for air at the cabinet is less than a reference value, wherein the reference value is less than thirty percent relative humidity.

2. The refrigerator appliance of claim 1, further comprising a wick positioned within the evaporation pan, the wick spaced from the evaporator within the evaporation pan, the wick configured for wicking liquid water from the evaporation pan towards the flow of air from the air handler.

3. The refrigerator appliance of claim 1, wherein the humidity sensor comprises a resistive humidity sensor, a capacitive humidity sensor, a thermal conductivity humidity sensor or a psychrometer.

4. The refrigerator appliance of claim 1, further comprising a water conduit and a valve coupled to the water conduit, an outlet of the water conduit positioned at the evaporation pan, the controller in operative communication with the valve, the controller configured for opening the valve in order to direct water into the evaporation pan via the water conduit.

5. The refrigerator appliance of claim 4, wherein the water conduit is configured for connecting to an external water supply.

6. The refrigerator appliance of claim 4, further comprising a water level sensor positioned adjacent the evaporation pan, the water level sensor configured for determining a height of water within the evaporation pan, the water level sensor configured for determining a height of water within the evaporation pan, the controller in operative communication with the water level sensor, the controller configured for opening the valve when the water level sensor signals that the height of water within the evaporation pan is less than a predetermined height.

7. The refrigerator appliance of claim 1, further comprising a drain line having an inlet positioned at the evaporator and an outlet positioned at the evaporation pan.

8. The refrigerator appliance of claim 1, further comprising a temperature sensor, the controller in operative communication with the temperature sensor.

9. The refrigerator appliance of claim 1, wherein the sealed system further comprises a compressor positioned within the mechanical compartment of the cabinet.

10. The refrigeration appliance of claim 1, further comprising an ice maker and an ice bucket.

11. The refrigeration appliance of claim 10, further comprising a drain conduit, the drain conduit having an inlet positioned at the ice bucket and an outlet positioned at the evaporation pan.

12. A refrigerator appliance, comprising:

a cabinet that defines a chilled chamber, the cabinet also defining a mechanical compartment at a bottom portion of the cabinet;

a sealed system charged with a refrigerant and configured for generating chilled air within the chilled chamber of the cabinet;

a humidifier positioned with the mechanical compartment of the cabinet, the humidifier comprising a humidity sensor configured for measuring a humidity of air at or around the cabinet; and a controller in operative communication with the humidity sensor and the humidifier, the controller configured for receiving a humidity measurement from the humidity sensor indicating the humidity of air at or around the cabinet, the controller further configured to activate the humidifier in order to increase the humidity of air at or around the cabinet if the humidity measurement is less than a reference value.

13. The refrigerator appliance of claim 12, wherein the humidifier comprises a cool mist humidifier, a warm mist humidifier, an ultrasonic humidifier or a mechanical humidifier.

14. A method for operating a refrigerator appliance comprising a cabinet and a sealed system, the cabinet defining a chilled chamber and a mechanical compartment, the mechanical compartment positioned at a bottom portion of the cabinet, the sealed system comprising a condenser and an evaporator, the condenser positioned within the mechanical compartment, the evaporator positioned at the chilled chamber, the method comprising:

directing refrigerant through the condenser of the refrigerator appliance;

measuring a relative humidity of air about the cabinet of the refrigerator appliance; and humidifying air about the cabinet of the refrigerator appliance by operating an air handler of the refrigerator appliance in order to direct a flow of air across the condenser and an evaporation pan of the refrigerator appliance if when the relative humidity of air about the cabinet of the refrigerator appliance is less than a reference value at said step of measuring, liquid water within the evaporation pan evaporating during said step of humidifying, wherein the reference value is less than thirty percent relative humidity.

15. The method of claim 14, wherein the relative humidity of air about the cabinet of the refrigerator appliance increases during said step of humidifying until the relative humidity of air about the cabinet of the refrigerator appliance is greater than the reference value.

16. The method of claim 14, further comprising opening a valve of the refrigerator appliance in order to direct water into the evaporation pan.

17. The method of claim 16, wherein said step of opening comprises opening the valve if a height of water within the evaporation pan is less than a predetermined height.

18. The method of claim 17, further comprising measuring the height of water within the evaporation pan with a water level sensor of the refrigerator appliance prior to said step of opening.

* * * * *